US006338342B1

(12) United States Patent
Fecteau et al.

(10) Patent No.: US 6,338,342 B1
(45) Date of Patent: Jan. 15, 2002

(54) RESPIRATOR HEADPIECE AND RELEASE MECHANISM

(75) Inventors: Keith E. Fecteau, Wilbraham; David Honan, Concord; Kevin Krauss, Brighton, all of MA (US)

(73) Assignee: Cabot Safety Intermediate Corporation, Southbridge, MA (US)

( * ) Notice: Subject to any disclaimer, the term of this patent is extended or adjusted under 35 U.S.C. 154(b) by 0 days.

(21) Appl. No.: 09/255,601

(22) Filed: Feb. 22, 1999

(51) Int. Cl.[7] ..... A62B 18/08

(52) U.S. Cl. ..... 128/207.11; 128/201.24; 128/202.27; 128/206.27; 128/207.17; 128/204.27

(58) Field of Search ..... 128/207.11, 206.12, 128/201.24, 202.27, 206.27, 207.17, 206.28, 206.24, 204.27

(56) References Cited

U.S. PATENT DOCUMENTS

| | | | | |
|---|---|---|---|---|
| 2,780,224 A | | 2/1957 | Wallace | |
| 2,814,293 A | * | 11/1957 | Gabb | 128/146 |
| 2,875,757 A | | 3/1959 | Galleher, Jr. | |
| 2,921,581 A | * | 1/1960 | Swearingen | 128/146 |
| 3,013,556 A | | 12/1961 | Galleher, Jr. | |
| 3,040,741 A | | 6/1962 | Carolan | |
| 3,056,402 A | | 10/1962 | Dickinson | |
| 3,079,917 A | * | 3/1963 | Pate | 128/146 |
| 3,092,105 A | | 6/1963 | Gabb | |
| 3,117,574 A | | 1/1964 | Replogle | |
| 3,234,939 A | | 2/1966 | Morton, Jr. | |
| 3,234,940 A | | 2/1966 | Morton, Jr. | |
| 3,347,229 A | * | 10/1967 | Heitman | 128/146.3 |
| 3,379,195 A | | 4/1968 | Bleach | |
| 3,457,564 A | | 7/1969 | Holloway | |
| 3,563,600 A | * | 2/1971 | Converse | 297/254 |
| 3,574,862 A | * | 4/1971 | Jones et al. | 285/367 |
| 3,599,635 A | | 8/1971 | Ansite | |
| 3,752,157 A | * | 8/1973 | Malmin | 128/146.7 |
| 3,815,326 A | * | 6/1974 | Christensen | 57/8 |
| 3,850,168 A | | 11/1974 | Ferguson et al. | |
| 4,850,346 A | | 7/1989 | Michel et al. | |
| 4,934,361 A | | 6/1990 | Michel et al. | |
| 4,955,087 A | | 9/1990 | Perez et al. | |
| 4,960,121 A | | 10/1990 | Nelson et al. | |
| 5,062,421 A | | 11/1991 | Burns et al. | |
| 5,406,340 A | | 4/1995 | Hoff | |
| 5,433,612 A | | 7/1995 | Daku | |
| 5,441,046 A | | 8/1995 | Starr et al. | |
| 5,464,010 A | | 11/1995 | Byram | |
| 5,517,986 A | | 5/1996 | Starr et al. | |
| 5,555,571 A | | 9/1996 | McCaffrey | |

(List continued on next page.)

FOREIGN PATENT DOCUMENTS

| | | |
|---|---|---|
| WO | WO 9640370 | 12/1996 |

*Primary Examiner*—John G. Weiss
*Assistant Examiner*—V. Srivastava
(74) *Attorney, Agent, or Firm*—Cantor Colburn LLP

(57) ABSTRACT

A quick release mechanism and headpiece for use with a respirator. The quick release mechanism uses an over center latch pivotly attached to a yoke to control the tension in a pair of upper tension cords. In the latched position the upper tension cords traverse the yoke and together with a pair of lower tension cords support and seal the respirator mask against the face of the wearer. In the unlatched position the upper tension cords loosely support the mask below the chin of the wearer in a parked position. The upper and lower tension cords are attached to a circular shaped headpiece having a crown piece fitting to the top of the head of the wearer and a base portion fitting to the back of the head of the wearer. The headpiece is advantageously comprised of multiple layers wherein the outer layer is comprised of a rigid material and the inner layer is comprised of a compliant material. The rigid layer provides necessary structure to headpiece and the inner layer provides compliance and comfort to the head of the wearer.

17 Claims, 11 Drawing Sheets

U.S. PATENT DOCUMENTS 5,592,937 A 1/1997 Freund
5,596,652 A 1/1997 Piatek et al.
5,608,917 A 3/1997 Landis et al.
5,793,882 A 8/1998 Piatek et al.
5,990,793 A 11/1999 Bieback
6,029,889 A 2/2000 Whalen, Jr. et al.

* cited by examiner

RESPIRATOR HEADPIECE AND RELEASE MECHANISM

BACKGROUND OF THE INVENTION

1. Field of the Invention

The invention relates generally to respirators and in particular to a novel headpiece and mask release mechanism.

2. Prior Art

Respirators are worn by persons subjected to unpleasant or noxious environments. A common type of respirator is the half mask respirator comprised of a cup type mask supported by a yoke attached to two sets of elastic straps. One set of straps, the upper set, is designed to rest on the crown of the head of a wearer. The second, lower, set is designed to wrap around the back of the neck of the wearer. The upper set is generally attached to a broadened flexible strap, commonly known as a cradle, that fits over, or cradles, the crown of the head. The upper strap is generally adjustably attached between the mask portion and cradle by a buckle having an adjusting mechanism such as a D-ring for tightening the strap against the head. A D-ring, as is well known in the industry, generally requires that a wearer use two hands to manipulate the D-ring to adjust the length of the strap during donning or doffing often proving to be challenging to the wearer. The lower strap generally includes a fastening element including a hook and slot arrangement and further includes an adjustment mechanism such as a D-ring.

A wearer typically puts on (dons) the respirator by clipping the lower straps behind the neck and then lifting the cradle up onto the top of the crown while simultaneously guiding the mask and yoke portion, or facepiece, into position on the face. The straps are then manipulated through the D-rings and adjusted until a good fit is achieved and a successful face seal check is performed. Removal, or doffing, of the respirator is performed opposite the donning operation wherein the lower straps are unbuckled and the cradle is removed from the head while the facepiece is withdrawn from the face of the wearer.

In the course of an average day a worker required to wear a respirator may don and doff the respirator up to 20 times. The donning procedures of current art respirators, including adjustment and face seal check, are viewed by many wearers as being complex and cumbersome. In some cases wearers forego the donning procedure when it is perceived that the task they are to perform would take less time than the donning procedure. The donning procedure is further complicated by other protective equipment such as goggles, glasses, earmuffs, hats and hard hats that need to be removed in order to don or doff the respirator.

The doffing of current respirators is viewed by many wearers as an equally cumbersome task. In order to remove the respirator, even for short periods, the lower strap must be unbuckled and the cradle lifted off the head as described herein above. A temporary removal, or parking, of the respirator is performed by slipping the cradle off the back of the head and allowing the facepiece to drop in front of the wearer wherein the respirator is supported by the lower strap around the neck of the wearer. Both the complete doffing and the parking of the respirator are further hampered by the inclusion of safety equipment as set forth herein above. While the respirator is in the parked position the buckle typically rubs along the neck of the wearer causing irritation and discomfort. In some prior art respirators, the buckle rubs the neck of the wearer in the donned position because the facepiece, upper straps cradle and lower straps all move with the wearer's head while the neck remains stationary. This rubbing causes similar discomfort to the wearer especially when the wearer's job requires frequent side to side or up and down head motion. Attempts have been made in the prior art to combine the crown strap and the neck strap to eliminate the rubbing problem. In most of the attempts the neck straps and crown straps lack sufficient structure to preclude the combination from collapsing over the ear of the wearer. Another problem with prior art attempts at combining the straps is the ability to position the straps on top of the head of the wearer far enough to preclude it from falling off while simultaneously avoiding interference with the wearer's peripheral vision.

Yet another problem with prior art respirators is that the straps, usually rectangular in cross section, twist and make it difficult to adjust using the D-rings. Another problem with prior art respirators is that the strap attachments, as well as tightening and release mechanisms, cause point loads in the facepiece making them uncomfortable to the wearer.

SUMMARY OF THE INVENTION

The above-discussed and other drawbacks and deficiencies of the prior art are overcome or alleviated by the respirator headpiece and quick release mechanism of the present invention. The quick release mechanism uses an over center latch pivotly attached to a yoke to control the tension in a pair of upper tension cords. In the latched position the upper tension cords traverse the yoke and together with a pair of lower tension cords support and seal the respirator mask against the face of the wearer. In the unlatched position the upper tension cords loosely support the mask below the chin of the wearer in a parked position. The upper and lower tension cords are attached to a circular shaped headpiece having a crown piece fitting to the top of the head of the wearer and a base portion fitting to the back of the head of the wearer. The headpiece is advantageously comprised of multiple layers wherein the outer layer is comprised of a rigid material and the inner layer is comprised of a compliant material. The rigid layer provides necessary structure to headpiece and the inner layer provides compliance and comfort to the head of the wearer.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
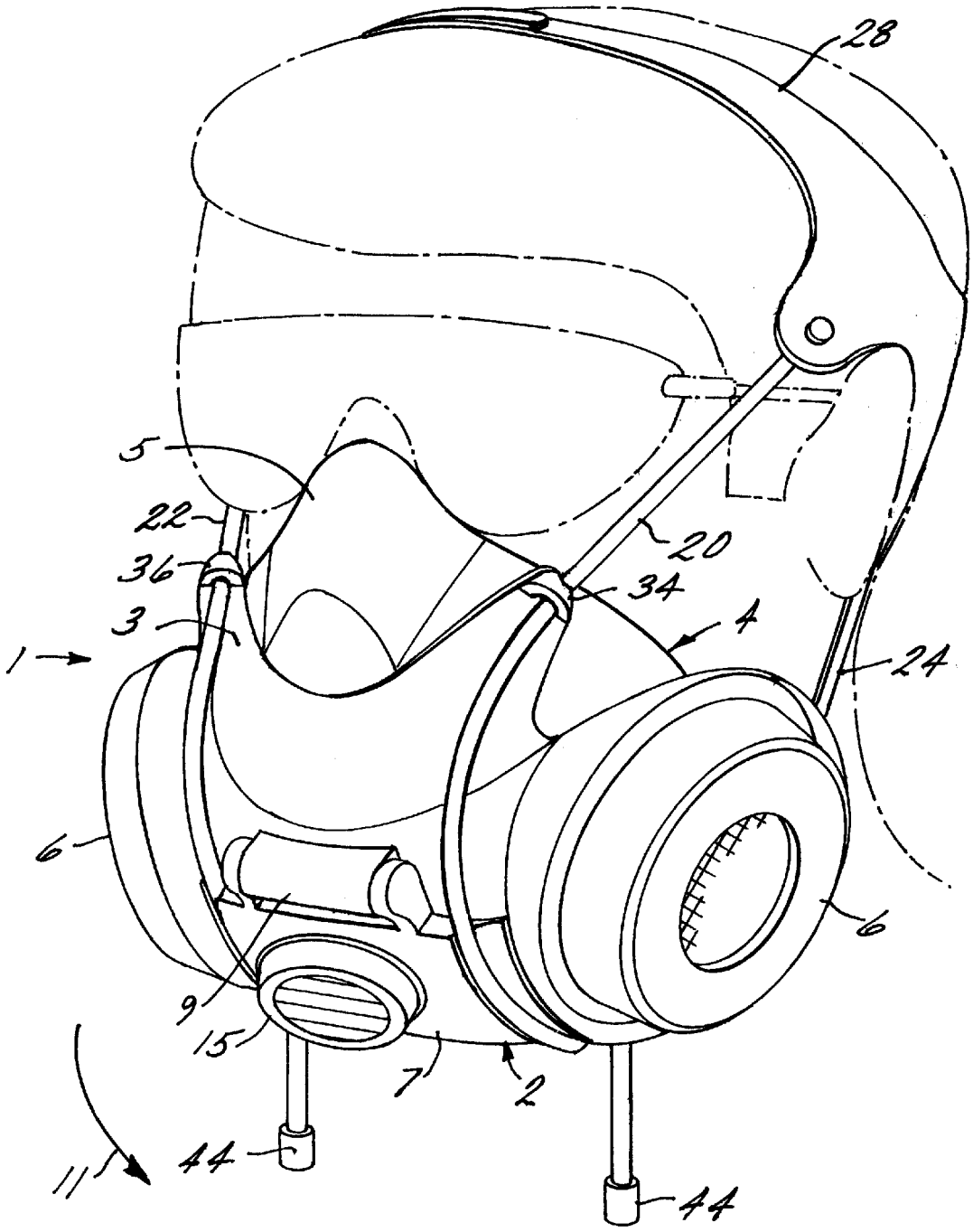
FIG. 1 is a front perspective view of a respirator in accordance with the present invention showing the latched position.
Figure 2:
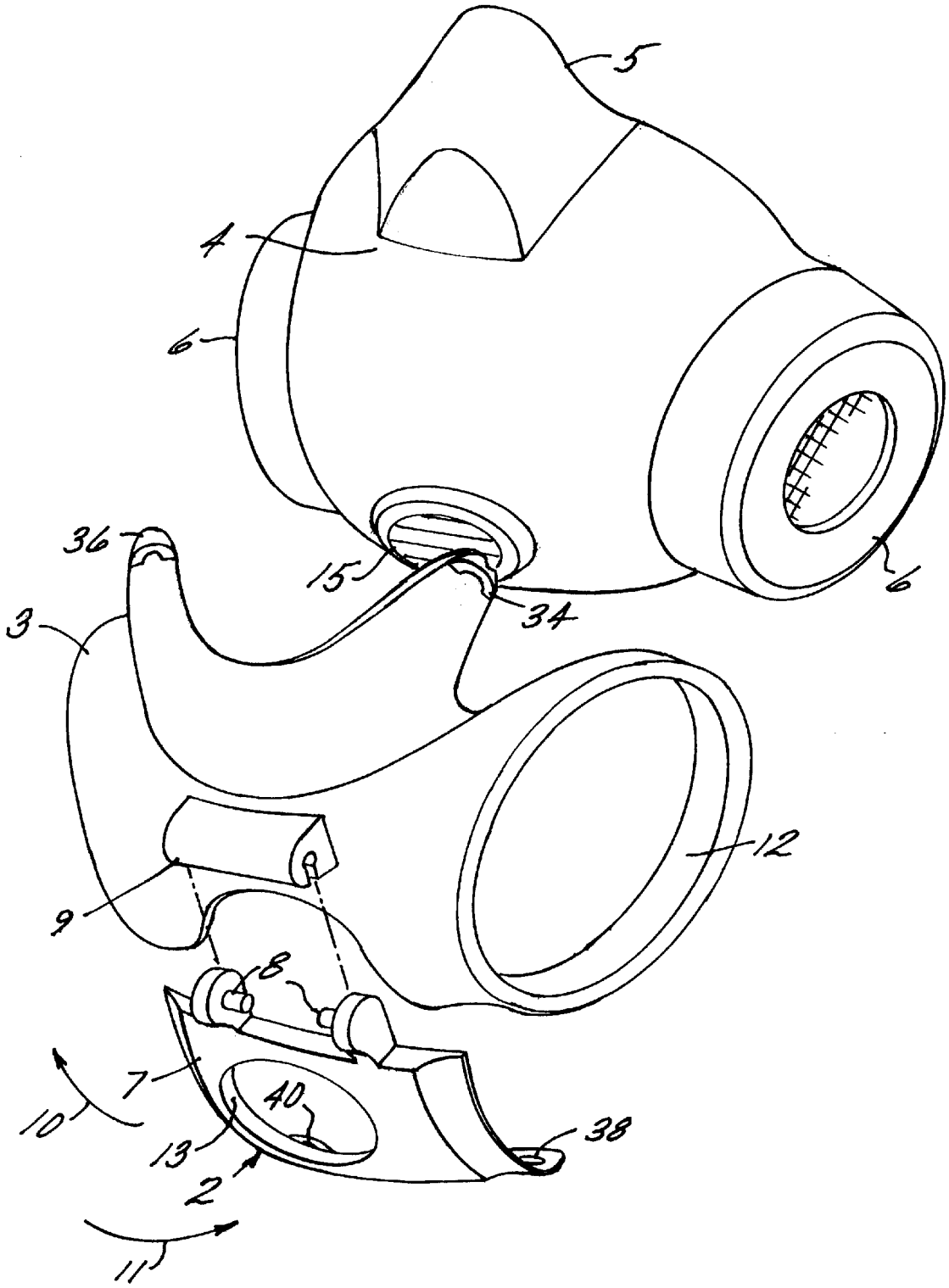
FIG. 2 is a perspective illustration of a quick release mechanism.

Referring to FIG. 1 a respirator 1 incorporates a quick release mechanism 2 into a facepiece support system, or yoke, 3. Facepiece 4 is supported by yoke 3 to fit mask portion 5 against the face of a wearer and includes filters 6 positioned on opposite sides. Yoke 3 attaches to facepiece 4 in a removable snap fit fashion against a button type stud (not shown) similar to that of prior art respirators. With filters 6 disposed within cartridge openings 12. Referring to FIG. 2, quick release mechanism 2 consists of an over center cam latch 7 pivotly attached to yoke 3 via hinge pins 8 disposed within hinge 9 and further includes relief cut 13 to accommodate exhale valve 15 while in the latched position. Hinge 9 serves as the pivot point of latch 7 whereby the latch is allowed to rotate outward in the direction indicated by arrow 10 to unlatch the respirator and inward in the direction indicated by arrow 11 to latch the respirator as will be more fully explained hereinbelow. The arrangement of hinge pins 8 and hinge 9 described herein is assembled in snap fit fashion allowing for quick and easy manufacture and assembly of the facepiece 4 of the present invention.

Figure 3:
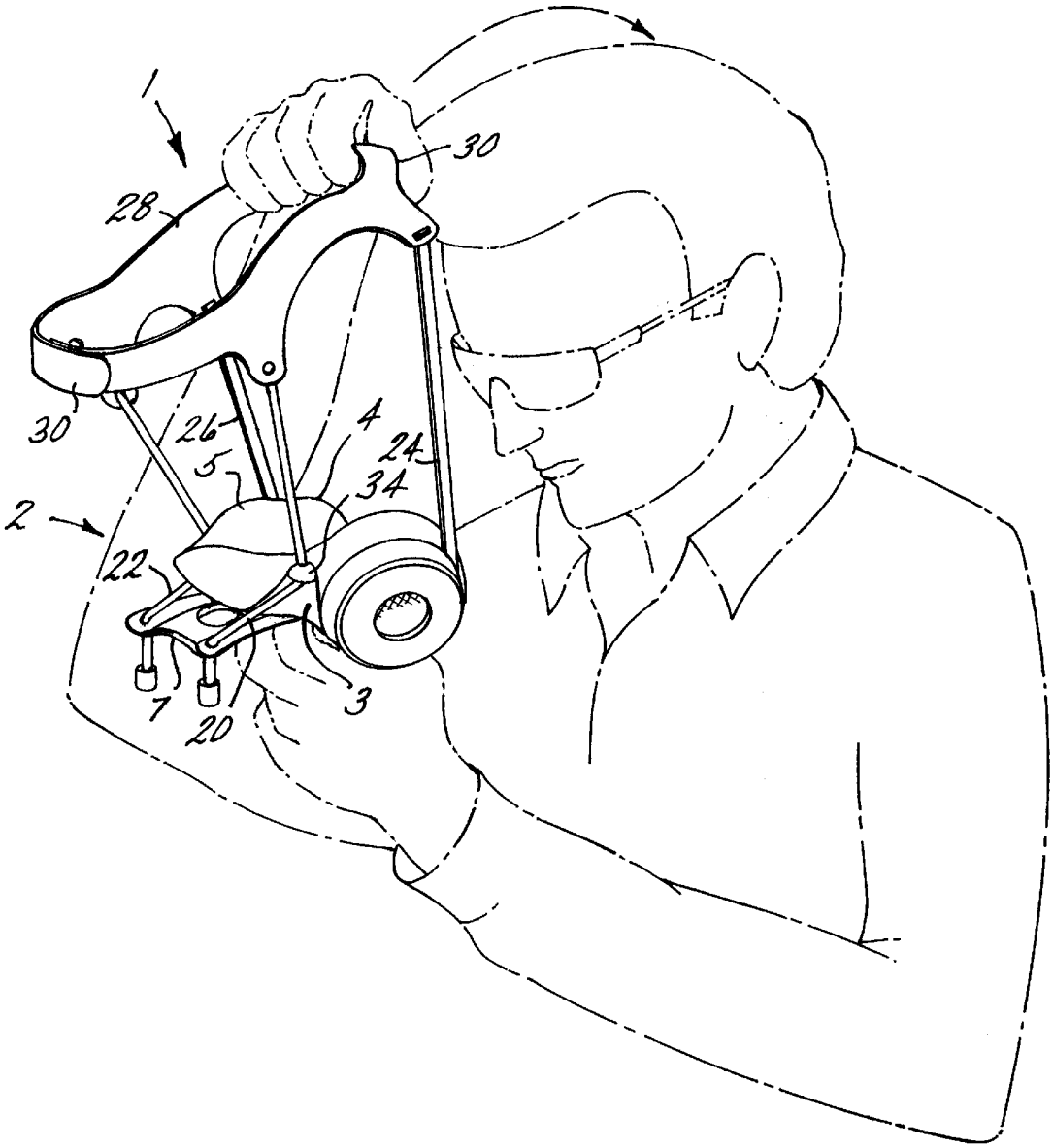
FIG. 3 is a perspective illustration of a wearer donning a respirator of the present invention.

As best shown in FIG. 3 respirator 1 is donned with latch 7 of quick release mechanism in the up and unlatched position by a wearer grasping base portion 30 of headpiece 28 with one hand and facepiece 4 with the other hand. Headpiece 28 is guided over the top of the head wherein base portion 30 is positioned around the back of the head and crown portion 32 is positioned near the top of the head. Simultaneously mask portion 5 of facepiece 4 is guided against the mouth and nose area of the wearer.

As best shown in FIG. 1 latch 7 of quick release mechanism is rotated in the direction indicated by arrow 11 into the latched position tensioning upper cords 20, 22 and biasing facepiece 4 against the face of the wearer. Upper cords 20, 22 attach to headpiece 28 and run through guide holes 34, 36 in yoke 3 and further pass through lock holes 38, 40 (FIG. 5) in latch 7. Tightening of respirator 1 is accomplished by pulling on ends 42, 44 of upper cords 20, 22 while latch 7 is in the latched position. Upper cords 22, 24 bind with guide holes 34, 36 and lock holes 38, 40 while in the latched position maintaining tension in the upper cords and biasing the facepiece against the face of the wearer.

Figure 4:
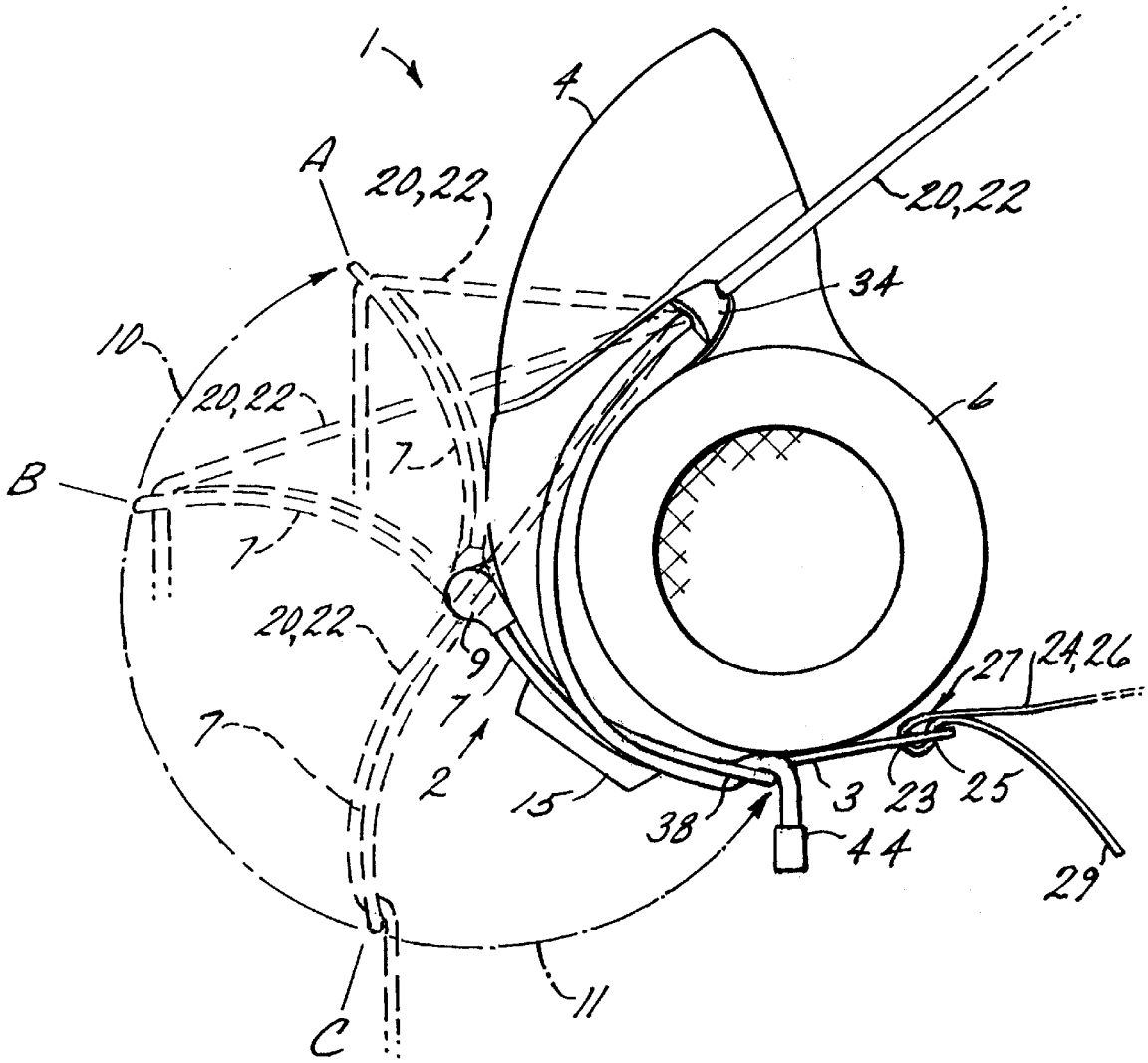
FIG. 4 is a left side view of a respirator of the present invention showing the latch movement.

The over-center latching feature of quick release mechanism 2 is best shown in FIG. 4 where, as described herein above, respirator 1 is supported and biased against the face of the wearer by upper tension cords 20, 22 and lower tension cords 24, 26 attached to headpiece 28 fitted over the top and back of the head of the wearer. Hinge 9 allows latch 7 to rotate outward in the direction of arrow 10 from the face and in a downward opposite direction indicated by arrow 11 pulling the ends 42, 44 of the upper cords 20, 22 and increasing the tension in the cords. In the donning operation, latch 7 is moved in the direction of arrow 11 and upper cords 20, 22 are moved therewith from the position designated "A"(unlatched) to the latched position shown in the figure through intermediate positions designated as "B" and "C". As latch 7 is rotated in the direction of arrow 11, upper cords 20, 22 slide through guide holes 34, 36 and cross a line running through the center of the axis of the hinge 10 from guide holes 34, 36 shown as position "C". After latch 7 passes further in the direction of arrow 11 the quick release mechanism cams over to the latched position via the tension in cords 20, 22 wherein the tension in the cords bias latch 7 upwards under the chin area of the facepiece 4. The cords 20, 22 run through guides 34, 36 which are integral with yoke 3 as described herein above. When the latch 7 is in the latched position under the chin of the wearer, cords 20, 22 support facepiece 4 and bias it towards the face of the wearer.

Figure 5:
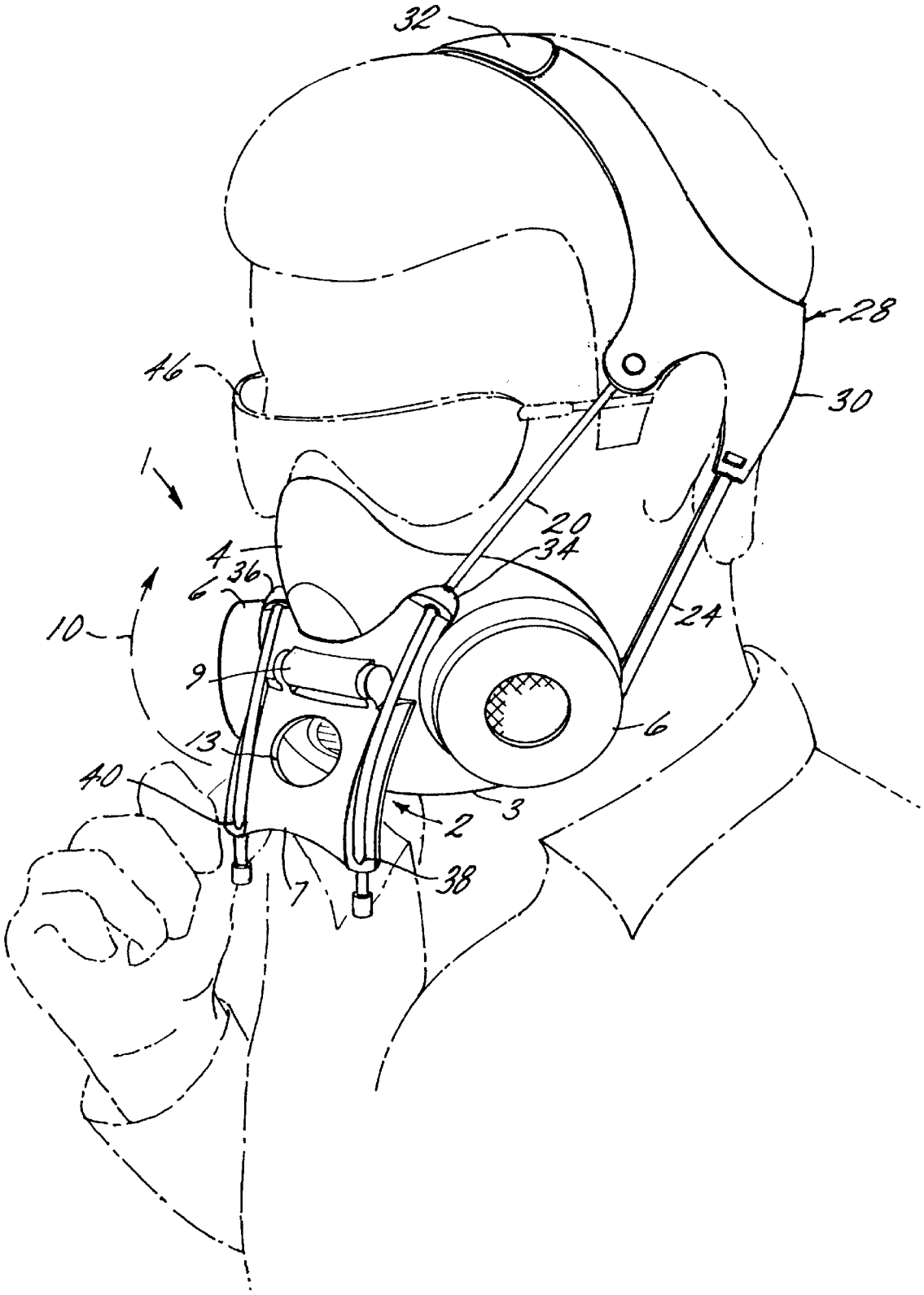
FIG. 5 is a perspective illustration of a respirator showing the actuation of the quick release mechanism.

Doffing of respirator 1 is best shown with reference to FIG. 5 wherein it is shown that latch 7 is unlatched by a user rotating the latch about hinge 9 in the direction indicated by arrow 10. As latch 7 is rotated by a wearer from the latched position to the position indicated as "C" in FIG. 4 upper cords 20, 22 pass through a line extending from hinge 9 and quick release mechanism 2 cams over into the unlatched position partially by tension in the cords and partially by the weight of the respirator. As described and shown herein, quick release mechanism 2 is actuated simply by applying thumb pressure against latch 7 and rotating the latch in the direction of arrow 10. In addition, respirator 1 in accordance with the present invention can be doffed without the removal of other safety head gear such as, for example, safety glasses 46.

Figure 6:
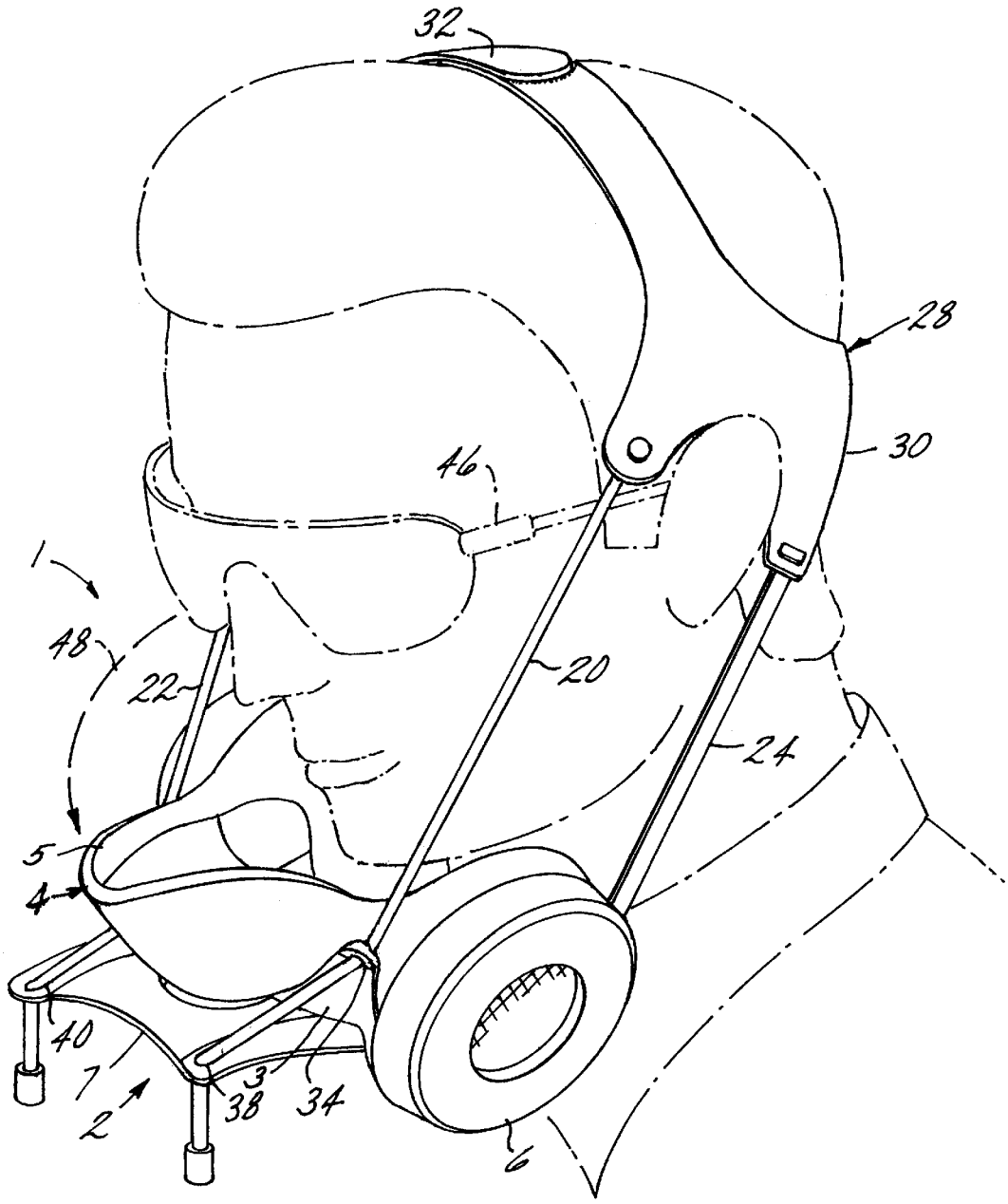
FIG. 6 is a perspective illustration of a respirator of the present invention in a parked position.

Respirator 1 of the present invention provides for a convenient and comfortable parked position as best shown in FIG. 6. Once respirator 1 is doffed as described herein before, ends 42, 44 of upper cords 20, 22 move closer to the wearer's face and the effective length of the upper cords is increased and facepiece 4 drops away from the face of the wearer in the direction indicated by arrow 48. In one embodiment, the length of cords 20, 22 between guide holes 34, 36 and their attachment to headpiece 28 increases by 4 inches from the latched to the unlatched position. Respirator 1 is effectively parked without removal of headpiece 28 from the neck or from the top of the head. Donning the respirator 1 from the "parked" position requires that the facepiece 4 be lifted with into position on the face while the cam latch 7 is flipped downward in direction arrow 1 preferable with the use of just one hand.

In a preferred embodiment, the upper cord 20, 22 is comprised of a resilient cord having a substantially circular cross section having the flexibility to trace out the path from headpiece 28 through yoke 3 to latch 7 in both the latched and unlatched position. Elastic straps of the prior art, as described herein above, having a rectangular cross section are limited to following a geodesic path and are not well suited for this application. In addition, elastic straps, although usable with the present invention, tend to twist and would not bind properly within guide holes 34, 36 and locking holes 38, 40. Lower tension cords 24, 26 are preferably comprised of flat elastic straps as will be more fully described herein below. As best shown in FIG. 1, upper cords 20, 22 support and seal facepiece 4 against the face of the wearer by spreading the tension load in the cords across the yoke 3 and mask portion 5. Spreading the loads as described creates a tight, yet comfortable, fit and seal of mask portion 5 against the face of the wearer. In addition, it is preferable that mask portion 5 be comprised of a resilient material, such as liquid silicone, rubber, or a thermoplastic elastomer, and that yoke 3 and latch 7 be comprised of a somewhat structural material such as polypropylene.

Figure 7:
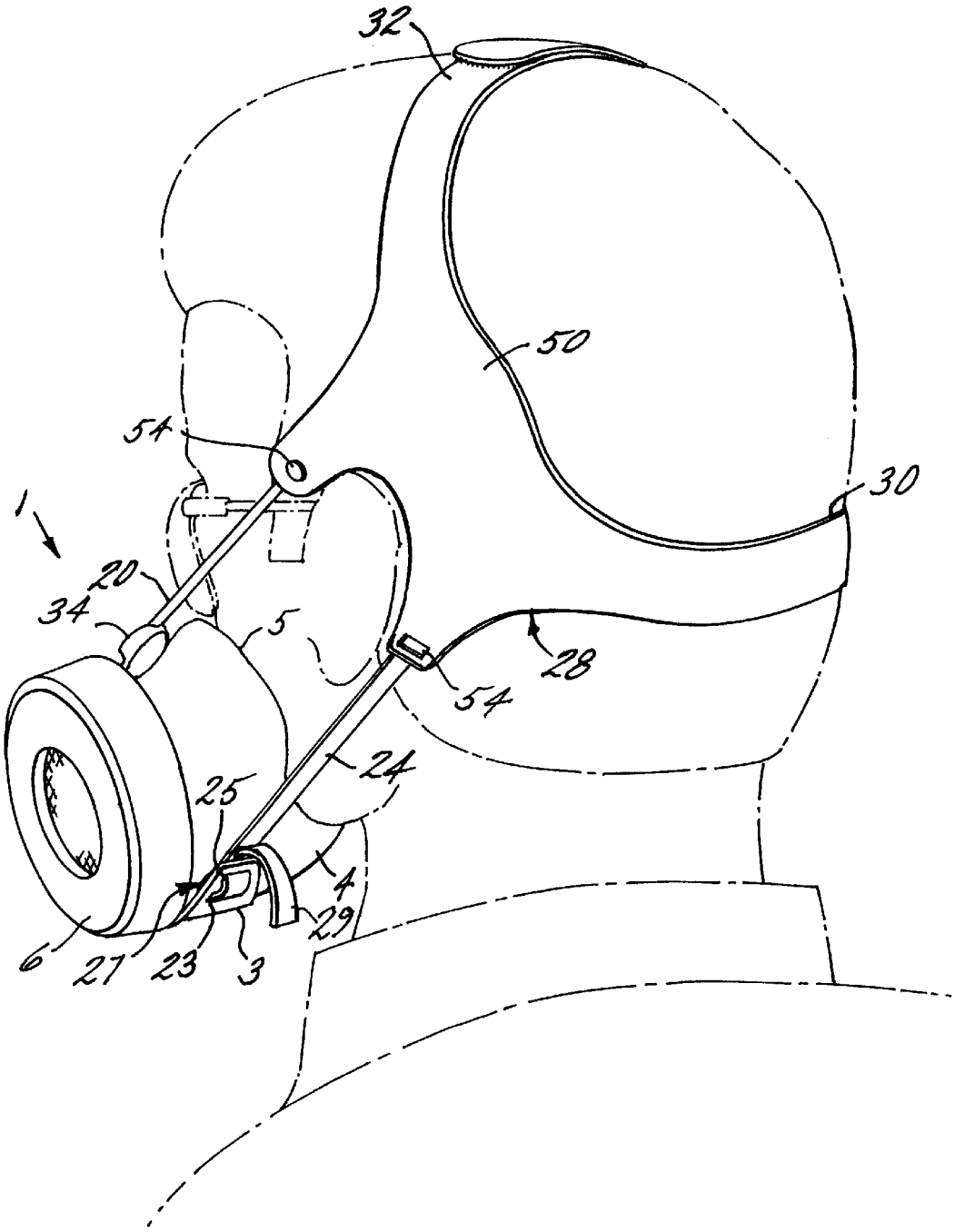
FIG. 7 is a rear perspective view of a respirator in accordance with the present invention showing a headpiece.

A preferred method of attaching lower straps 24, 26 to yoke 3 is shown with reference to FIGS. 4 and 7. In the embodiment shown yoke 3 includes a pair of slots 23, 25 forming a cinching mechanism 27 through which lower straps 24, 26 pass. The length of lower straps 24, 26 do not require frequent adjustment but may be adjusted by cinching mechanism 27. Straps 24, 26 are first passed through slot 23 positioned on either side of yoke 3 and then passed through slot 25 as shown. When end 29 is pulled by the wearer face piece 4 is pulled tighter to the wearer's face. Straps 24, 26 are loosened by pulling down on yoke 3 near slot 25. In another embodiment straps 24, 26 are positioned within a common D-ring (not shown) which is attached directly to yoke 3.

The performance of headpiece 28 is best described with reference to FIG. 7 wherein it is shown that base portion 30 is positioned above the neck of the wearer and crown portion 32 is positioned on the top of the head of the wearer. With crown portion 32 and base portion 30 integrally connected with side portions 50, 52 headpiece 28 forms a continuous ring which rests on top of the head and wraps around the back of the head towards, but preferably not contacting the neck. As will be more fully explained herein below, the embodiment of headpiece 28 shown in FIG. 7 is comprised of a one piece strap that is adjustably fastened together on crown portion 32 to form the continuous ring described. Because the entire head piece 28 moves with the wearer's head, and the respirator 1, there is no irritation to the back of the neck or to the back of the head as with prior art respirators. In accordance with the present invention, the attachment of upper cords 20, 22 and lower cords 24, 26 to headpiece 28 may be accomplished in a variety of ways and is shown by way of example in FIG. 7 as plastic rivets 54 swaged over by a known process such as ultrasonic welding.

Figure 8:
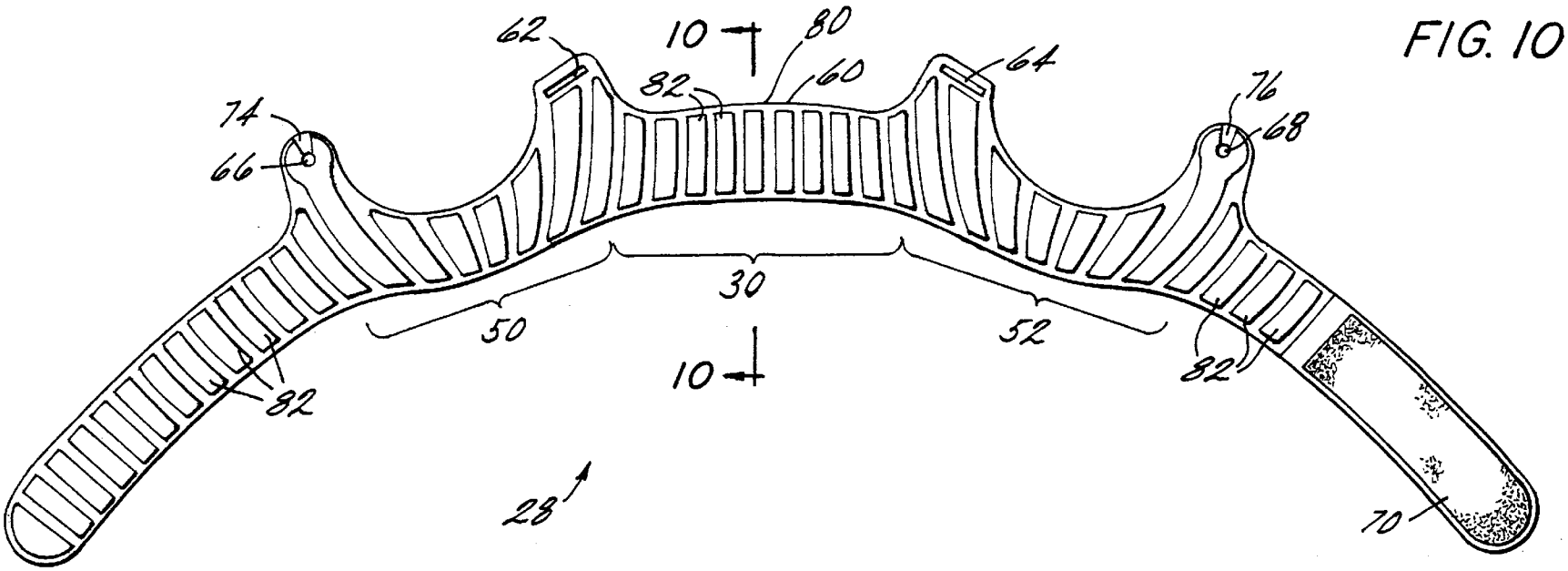
FIG. 8 is a plan view of the inside surface of a headpiece.
Figure 9:
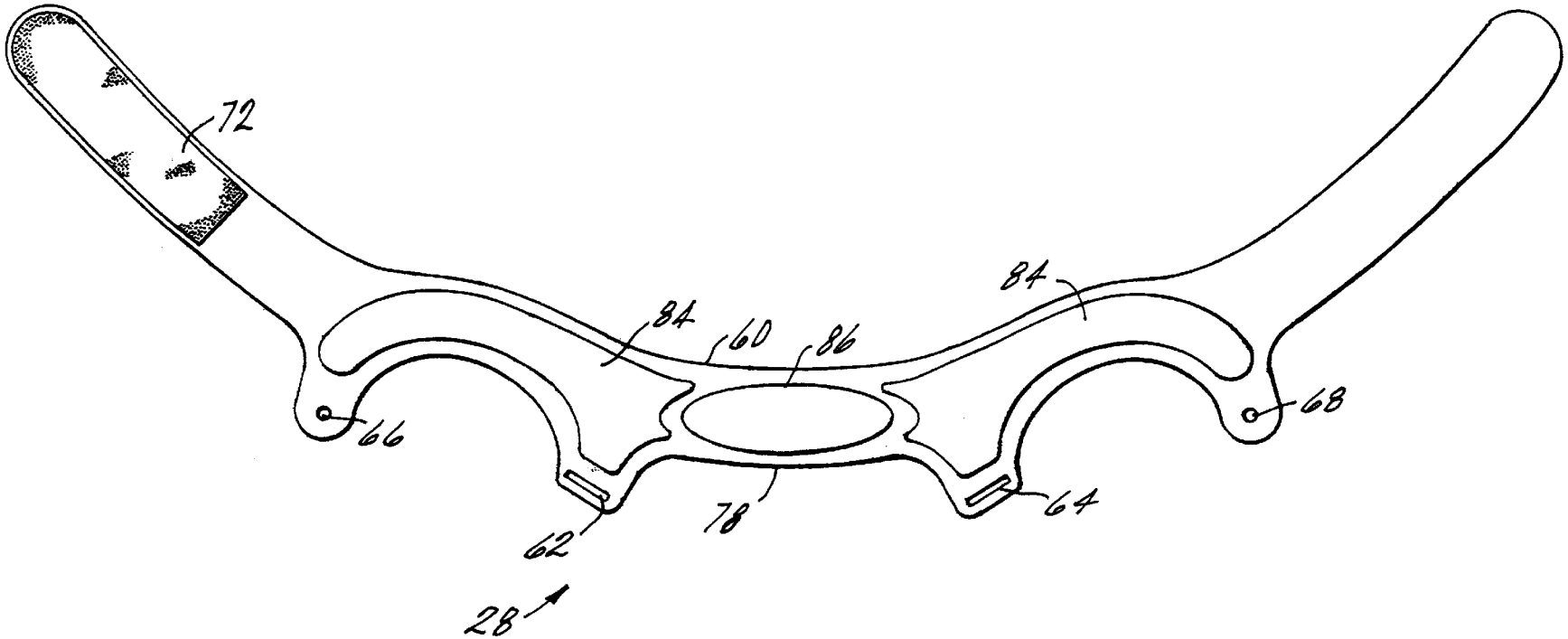
FIG. 9 is a plan view of the outside surface of the headpiece of FIG. 8.

The details of an embodiment of headpiece 28 are best shown with reference to FIGS. 8 and 9 wherein it is shown that the headpiece comprises a single strap 60. Base portion 30 is positioned between lower cord attachment loops 62, 64 and side portions 50, 52. Side portions 50, 52 are scalloped between upper cord attachment holes 66, 68 and lower cord attachment loops 62, 64 to allow relief around the ears of a wearer for use with other safety equipment such as protective muffs. As described herein above lower straps 24, 26 may be attached through loops 62, 64 by any suitable method such as sewn, glued, riveted, or looped through a conventional D-ring (not shown) attached to the loops 62, 64. The inside portion of headpiece 28, the side intended to contact the head of a wearer, is shown in FIG. 8 and includes a hooked fabric fastener patch 70 which releasably fastens to looped fabric fastener patch 72 on the outside surface of the headpiece as shown in FIG. 9. The position of patches 70, 72 may be reversed as is known without departing from the present invention. In a preferred embodiment, hooked fabric fastener patch 70 and looped fabric fastener patch 72 are comprised of Velcro® material and allow for headpiece 28 to be releasably adjustable to a wearer's head to accommodate a wide range of sizes. Patches 70, 72 are bonded, sewn, or otherwise attached to headpiece strap 60 by methods known in the art. Still referring to FIG. 8 headpiece 28 includes relief channels 74, 76 which run from the periphery of strap 60 to upper cord attachment loops 66, 68. The channels 74, 76 preclude upper cords 20, 22 (FIG. 7) from being pressed against the face of the wearer by strap 60.

Figure 10:
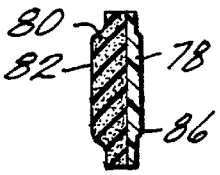
FIG. 10 is a cross sectional view of the headpiece of FIG. 8 along lines 10—10.

Strap 60 is shown in one embodiment in FIG. 10 as constructed from two materials preferably comprising a rigid plastic outer layer 78 and a compressible foam inner layer 80. In a specific embodiment outer layer 78 is comprised of a rigid plastic, such as polyethylene or polypropylene, and inner layer 80 is comprised of an elastomeric foam having a density of about 4–8 pounds per cubic foot. The two layers 78, 80 are joined together by a compression molding process, either with or without the use of a bonding agent or adhesive. Outer layer 78 provides headpiece 28 with sufficient rigidity to preclude collapse of ear portions 50, 52 and inner layer 80 provides compliance and comfort against the head of the wearer. As best shown in FIGS. 8 and 10 the inside portion of strap 60 includes pillows comprised of raised sections 82. The raised sections 82 are preferable molded into inner layer 80 of strap 60 during the compression molding process and represent areas of less compression force. The raised portions 82 provide a softer and thereby a more comfortable contact area against the head of a wearer. The raised portions further provide strap 60 with the directional flexibility necessary to form the strap into ring shaped headpiece 28 as shown in FIG. 7. In a particular embodiment pillows 82 are 0.040 inches in height and each layer is 0.040 in height prior to compression. It is within the scope of the present invention that outer layer 78 of strap 60 includes integrally molded design features such as patterns 84 and logo type indicia 86.

Figure 11:
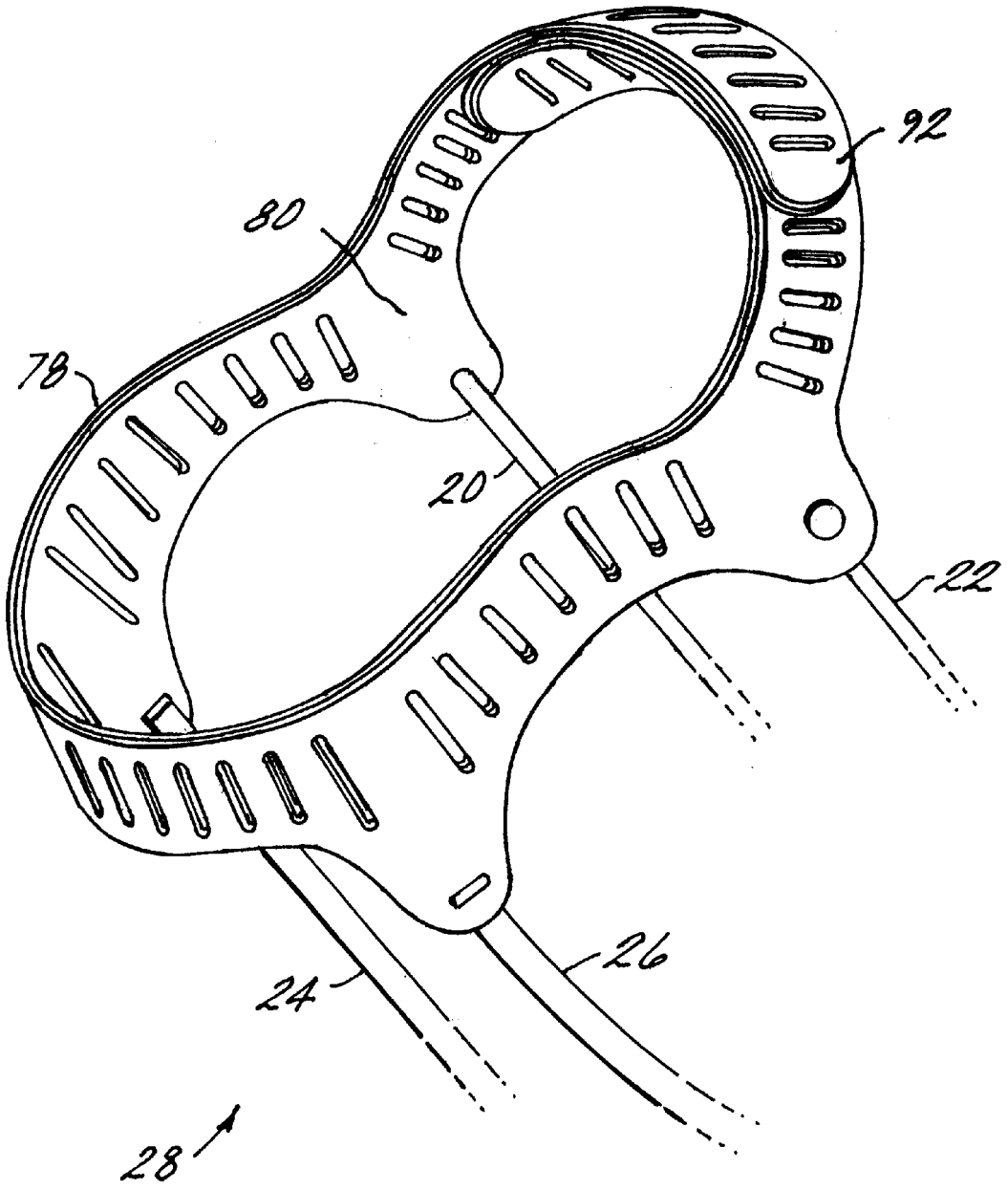
FIG. 11 is a perspective illustration of alternative embodiment headpiece.
Figure 12:
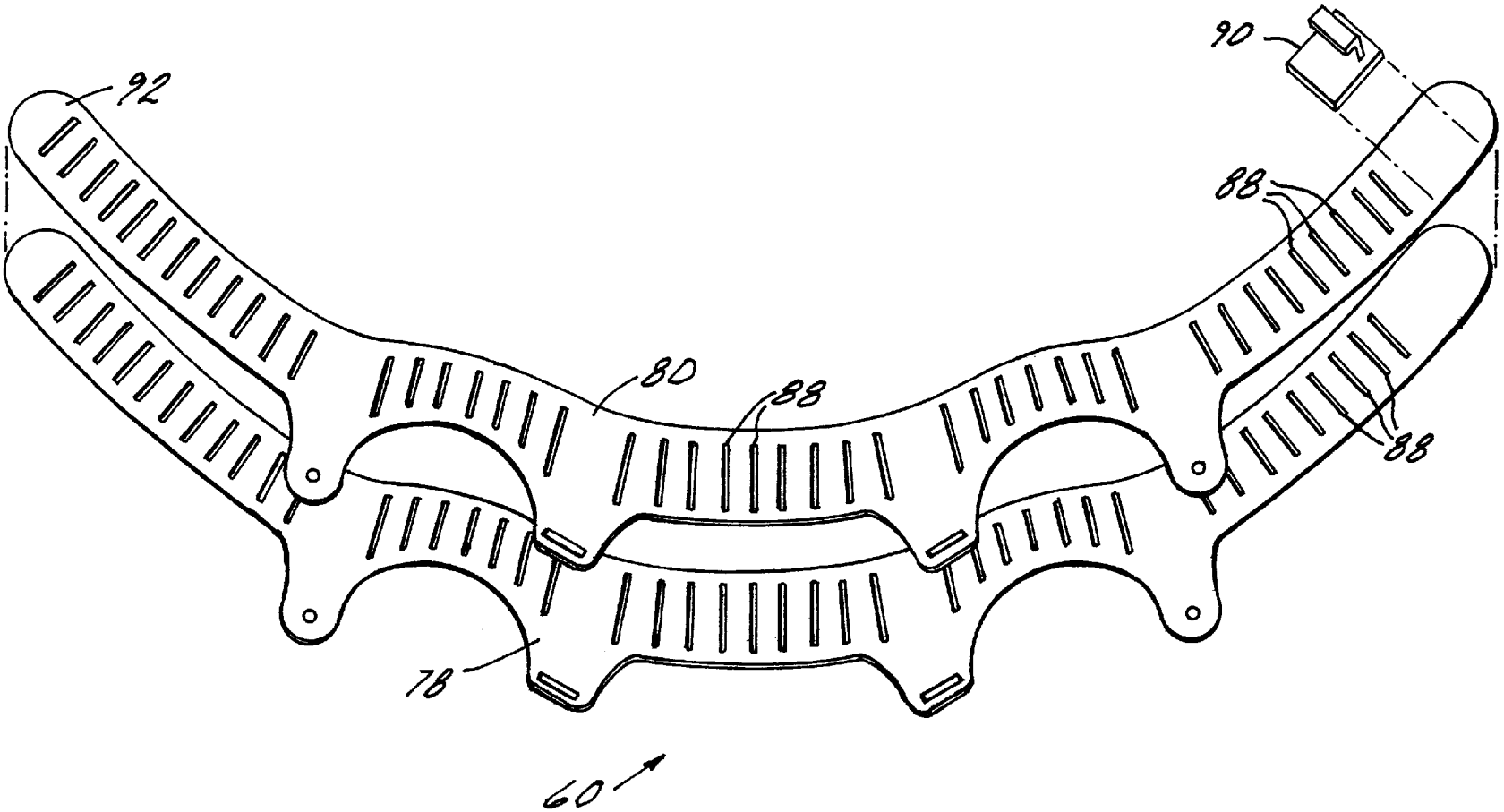
FIG. 12 is a perspective view of the headpiece of FIG. 11 in a preassembled state.

Referring now to FIGS. 11 and 12 an alternative embodiment headpiece 28 is shown therein including cutouts 88 in both the inner layer 80 and the outer layer 78 of strap 60. The cut outs 88 in each layer align with one another and form passages through strap 60 and serve to provide ventilation and flexibility to the strap. Size adjustment is incorporated into the headpiece 28 by locking tab 90 disposed on inner layer 80 and interlocking with cut outs 88 on the adjustment end 92 of strap 60. Locking tab 90 releasably hooks inside of the plurality of cooperating slots formed by cutouts 88 which when combined with locking tab 24 allow for the aforementioned adjustability for size.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A respirator to be worn on the head of a wearer, the respirator having a face mask portion to seal against the face of the wearer and cartridge type filters mounted on opposing sides of the mask, the respirator comprising:

a yoke attached to the face mask, the yoke having a pair of openings fitting over the filters, a hinge disposed on a front portion of the yoke, and a pair of guide holes positioned in the yoke;

a latch pivotally attached to the hinge, the latch pivoting between an unlatched and latched position and having a pair of lock holes positioned at an end portion opposite the hinge;

a headpiece forming a continuous substantially ring shape having a crown portion fitting over a top portion of the head, a base portion fitting over a back portion of the head, a side portion positioned on opposite sides of the ring between the crown portion and the base portion, an upper cord attachment hole positioned between each of the side portions and the crown portion, and a lower strap attachment loop positioned between each of the side portions and the base portion;

a pair of upper cords attached to the headpiece at the upper attachment holes and passing through the guide holes and the lock holes; and a pair of lower straps disposed between the lower strap attachment loops and a pair of attachment points positioned at a bottom portion of the yoke.

2. A respirator as set forth in claim 1 wherein the cords are comprised of a resilient material having a substantially round cross section.

3. A respirator as set forth in claim 1 wherein a tension force is produced in the cords in the latched position biasing the face mask against a face of a wearer and sealing the face mask to the face thereby.

4. A respirator as set forth in claim 1 wherein the attachment points each comprise a cinching mechanism comprising a pair of slots.

5. A respirator as set forth in claim 3 wherein the cinching mechanisms comprise a D-ring attached to the yoke.

6. A respirator as set forth in claim 1 wherein the yoke is comprised of a rigid plastic material.

7. A respirator as set forth in claim 1 wherein the latch is comprised of a rigid plastic material.

8. A respirator as set forth in claim 1 wherein the headpiece comprises a strap having a length, a first end and a second end and wherein the first end and second end are releasably attachable to one another to vary the length of the strap forming the continuous ring shape.

9. A respirator as set forth in claim 8 wherein the strap includes an inside surface and an outside surface and a hooked fastener patch is disposed on either the first end or second end and further on either the inside surface or the outside surface and a looped fastener patch is disposed on the end and on the surface opposite the hooked fastener patch and cooperates with the hooked fastener patch to releasably attach the ends in an overlap fashion.

10. A respirator as set forth in claim 9 wherein the strap includes a plurality of slots and wherein a hook is attached to either the first end or the second end and the hook cooperates with at least one of the slots to releasably attach the ends in an overlap fashion.

11. A respirator as set forth in claim 8 wherein the strap comprises at least an inner layer and an outer layer, wherein the inner layer is comprised of a resilient material and the outer layer is comprised of a rigid material.

12. A respirator as set forth in claim 11 wherein the resilient material is comprised of an elastomeric foam having a density from about 4 pounds per cubic foot to about 8 pounds per cubic foot.

13. A respirator as set forth in claim 11 wherein the rigid material is comprised of a plastic.

14. A respirator as set forth in claim 11 wherein the resilient layer includes a plurality of raised portions distributed along the length of the strap.

15. A respirator as set forth in claim 14 wherein the inner layer and the outer layer are joined in a compression molding process and wherein the raised portions are compression molded thereby.

16. A respirator as set forth in claim 11 wherein the inner layer and the outer layer are bonded together by a third layer positioned therebetween.

17. A respirator as set forth in claim 11 wherein the headpiece further comprises a relief channel disposed within the inner layer from each of the upper cord attachment holes to a periphery of the strap.

* * * * *

UNITED STATES PATENT AND TRADEMARK OFFICE

CERTIFICATE OF CORRECTION

PATENT NO. : 6,338,342 B1
DATED : January 15, 2002
INVENTOR(S) : Fecteau et al.

It is certified that error appears in the above-identified patent and that said Letters Patent is hereby corrected as shown below:

Column 4,
Line 3, after "hinge" delete "10" and insert therefor -- 9 --
Line 41, after "lifted" delete "with"
Line 42, after "in" delete "direction arrow 1 preferable" and insert therefor -- the direction of arrow 10 preferably --

Column 5,
Line 59, after "loops " delete "66, 68" and insert therefor -- 62, 64 --

Column 6,
Line 6, before "portions" delete "ear" and insert therefor -- side --
Line 10, after "are" delete "preferable" and insert therefor -- preferably --
Line 32, after "tab" delete "24" and insert therefor -- 90 --

Signed and Sealed this

Twenty-eighth Day of June, 2005

JON W. DUDAS
*Director of the United States Patent and Trademark Office*